US011602666B2

(12) United States Patent
Duenas

(10) Patent No.: US 11,602,666 B2
(45) Date of Patent: Mar. 14, 2023

(54) SQUAT AND SPINAL FITNESS AND REHABILITATION DEVICE

(71) Applicant: Richard Duenas, West Hartford, CT (US)

(72) Inventor: Richard Duenas, West Hartford, CT (US)

(73) Assignee: Richard Duenas, West Hartford, CT (US)

( * ) Notice: Subject to any disclaimer, the term of this patent is extended or adjusted under 35 U.S.C. 154(b) by 78 days.

(21) Appl. No.: 17/368,408

(22) Filed: Jul. 6, 2021

(65) Prior Publication Data

US 2022/0203161 A1 Jun. 30, 2022

Related U.S. Application Data

(60) Continuation of application No. 16/593,270, filed on Oct. 4, 2019, now Pat. No. 11,090,527, which is a division of application No. 15/167,728, filed on May 27, 2016, now Pat. No. 10,456,620.

(60) Provisional application No. 62/169,188, filed on Jun. 1, 2015, provisional application No. 62/169,174, filed on Jun. 1, 2015.

(51) Int. Cl.
*A63B 23/04* (2006.01)
*A63B 21/00* (2006.01)

(52) U.S. Cl.
CPC ..... *A63B 23/0405* (2013.01); *A63B 21/4011* (2015.10)

(58) Field of Classification Search
CPC ..... A63B 23/0405; A63B 21/4034; A63B 2023/0411; A63B 21/4033; A63B 21/0557; A63B 23/03525; A63B 21/4011–4015; A63B 69/0057; A63B 21/00047
See application file for complete search history.

(56) References Cited

U.S. PATENT DOCUMENTS

| | | | |
|---|---|---|---|
| 1,705,745 | A | 3/1929 | Anderson |
| 3,787,048 | A | 1/1974 | Bock |
| 3,817,243 | A | 6/1974 | Perrine |
| 5,050,868 | A | 9/1991 | Pearson |
| 5,263,919 | A | 11/1993 | Hollenback |
| 5,512,029 | A | 4/1996 | Barnard et al. |
| 5,529,558 | A | 6/1996 | Koenig |
| 5,603,678 | A | 2/1997 | Wilson |
| 5,941,803 | A | 8/1999 | Chamberlain et al. |
| 6,251,052 | B1 | 6/2001 | Simonson |
| 7,086,996 | B2 | 8/2006 | Matjacic et al. |
| 7,115,080 | B2 | 10/2006 | Cockrill, Jr. et al. |
| 7,678,033 | B2 | 3/2010 | Tyree |
| 8,007,414 | B2 | 8/2011 | Riney et al. |
| 8,328,698 | B1 | 12/2012 | Webber et al. |
| 8,597,165 | B1 | 12/2013 | Antonucci |
| 9,039,585 | B2 | 5/2015 | Derrick |
| 9,211,463 | B2 | 12/2015 | Giveans |
| 9,259,604 | B2 | 2/2016 | Miller, Jr. |
| 9,370,688 | B1 | 6/2016 | Pannozzo |
| 9,526,938 | B2 | 12/2016 | Chen |

(Continued)

*Primary Examiner* — Andrew S Lo
(74) *Attorney, Agent, or Firm* — Day Pitney LLP; Anthony A. Kassas

(57) ABSTRACT

Embodiments of an exercise device for squat training are disclosed. The exercise device disclosed herein provides users with a stable lower extremity base to help assure good motor function of the squat exercise to improve efficient flexibility, coordination, strength, and endurance development.

21 Claims, 8 Drawing Sheets

(56) References Cited

U.S. PATENT DOCUMENTS

| | | | |
|---|---|---|---|
| 9,539,460 | B2 | 1/2017 | Ellis |
| 2003/0181299 | A1 | 9/2003 | Matjacic et al. |
| 2004/0167000 | A1 | 8/2004 | Schwarz |
| 2006/0247097 | A1 | 11/2006 | La Voie et al. |
| 2006/0252612 | A1 | 11/2006 | Melcer |
| 2008/0199839 | A1 | 8/2008 | Fugitt |
| 2010/0274166 | A1 | 10/2010 | Terrio |
| 2013/0197403 | A1 | 8/2013 | Sevy et al. |
| 2014/0066275 | A1 | 3/2014 | Miller, Jr. |
| 2015/0265872 | A1 | 9/2015 | Sela |
| 2016/0038786 | A1 | 2/2016 | Cirino |
| 2016/0144218 | A1 | 5/2016 | Chen |
| 2016/0236025 | A1 | 8/2016 | Henan |

SQUAT AND SPINAL FITNESS AND REHABILITATION DEVICE

CROSS REFERENCE TO RELATED APPLICATIONS

This application is a continuation of and claims the benefit of priority to U.S. patent application Ser. No. 16/593,270 filed on Oct. 4, 2019, which is a divisional of and claims the benefit of priority to U.S. patent application Ser. No. 15/167,728, filed May 27, 2016, which in turn claims the benefit of priority to U.S. Provisional Patent Application Ser. No. 62/169,174, filed on Jun. 1, 2015 and to U.S. Provisional Patent Application Ser. No. 62/169,188, filed on Jun. 1, 2015; the entire disclosures of which are incorporated herein in their entirety, for any purpose whatsoever.

BACKGROUND OF THE INVENTION

1. Field of the Invention

The present invention relates to fitness and rehabilitation equipment in particular, the present invention is directed to a device for performing single or double leg squat exercises to ensure spinal fitness and rehabilitation.

2. Description of the Related Art

The squat is one of the first vertical movements humans assume, usually by one or two years of age. The squat is an important movement throughout life. Among other things, the squat is important for: general activities of daily living; occupational tasks such as lifting, pushing, pulling and stabilizing; recreational tasks such as for retrieving items from the floor or ground, balancing, and preparation of movement activities such as jumping, leaping and running; physical fitness tasks for improving flexibility, coordination, strength and endurance of the lower leg, knee, upper leg, hip, pelvis and spine regions and general conditioning for the whole body; athletic tasks for strength, endurance, basic positions of competition and preparation of movement activities such as jumping, leaping, running, balancing and others; specific body building fitness for increasing quadriceps and gluteus muscle girth and development of strength and endurance as well as for physical rehabilitation purposes of improving lower body and spinal flexibility, coordination, strength and endurance related to general de-conditioning (especially for the elderly), post injury and/or post-surgical treatment and general conditioning for the whole body.

Although used daily throughout life and often taken for granted, the single or double leg squat is an important capability for all persons, and enables mobility throughout one's entire life. Each person has their own squatting style as a result of their biomechanical development and training. Squatting is used during daily home activities, recreational, sport and fitness activities as well as work activities in particular jobs requiring lifting, pushing, pulling and carrying items from and to the floor. Generally, as adulthood is reached, the use of squatting is reduced. Thus, the flexibility, coordination, strength, endurance and smoothness of joint function of the squat may become compromised. With a loss of squatting motion and fitness, an individual may be predisposed to injury when the need to lift an object or move in a certain way is met. Subsequently normal activities of daily living such as squatting and reaching to the floor, lifting items from and to the floor, descending to a seated position, ascending to a standing position and ascending stairs are may be weakened and possibly intentionally avoided thus limiting the lifestyle function for the individual. With the elderly in particular, the ability to squat becomes substantially compromised when leg strength is reduced due to the aging process, spinal osteoarthritic conditions that affect nerve function to the musculoskeletal system of the lower extremity, osteoarthritic conditions that impair lower extremity biomechanics and the musculature is weakened from disuse atrophy. As a result, and especially for the elderly, an opportunity to gain the full physiological benefits of the squat is compromised thus predisposing the individual to falls and other impairments of activities of daily living.

The squat motion requires the balance and coordination of the lower leg, knee, upper leg, hip, pelvis and spine regions and will stimulate the thigh and hip musculature for development of balance, coordination, flexibility, strength and endurance. The single leg squat in particular requires similar lower extremity and spinal mechanics with particular attention to positioning of the center of gravity over the foot for an individual. Proper single leg squat mechanics requires the individual to establish comfortable foot position with the pelvic/hip region shifted over the foot with the knee directed along the long axis of the foot. As the knee is bent during the descent, the buttock is drawn backward, shoulders are as square as possible, the spine is near neutral as possible and the knee is maintained along the long axis of the foot. Upon reaching the desired depth of the squat, the individual ascends with the knee remaining along the long axis of the foot, hip, and knee extensor muscles are activated to straighten the knee and hip joints. The depth of squatting will vary according to need, interest. and the physiologic and biomechanical health status of related body regions.

Commonly observed errors of single or double leg squatting include; poor balance over the foot/feet; lower extremity; instability and in-coordination; poor control of the knee to remain behind or translating in front of the toes; poor control of the knee to remain centered along the long axis of the foot/feet; poor control of the hip to avoid excess internal or external hip rotation; and poor control of the pelvis and spine to shift backward during squat descent.

These errors can be corrected by providing stability to the lower extremity as the device is designed to function to assure a closed chain exercise mechanism is maintained to support the conditioning of the hip-thigh musculature at 0 to 130 degrees of knee range while the lower extremity at the calf and possibly the foot is secure to the device. This device has utility in supporting persons learning the single or double squat and training to improve balance, coordination, flexibility, strength, and endurance of the lower leg, knee, upper leg, hip, pelvis, and spine regions. Since the foot and lower leg are fixed to the braces while either fixing ankle motion or allowing ankle motion; the individual can focus on improving the strength and endurance of the lower leg, knee, upper leg, hip, pelvis and spine regions. This is very important for; elderly with lower body and spinal region de-conditioning and poor balance with difficulty in rising from the seated to standing position and descending to the seated and/or squat positions; general population, recreation, and fitness enthusiasts to improve strength and development of the thigh and hip extensor and internal knee ligament complex; athletes for training the region and strengthening the thigh and hip extensor and internal knee ligament complex; patients participating in rehabilitation of lower leg, knee, upper leg, hip, pelvis, and spine regions.

Good spinal mechanics and function are coordinated with the flexibility, coordination, strength, and endurance of the lower leg, knee, upper leg, hip, and pelvis regions. Loss or reduced function of one or more of these components may increase the susceptibility to injury of the spine through a single episode or repetitive stress episodes. The squat movement offers substantial biomechanical and physiologic demands of the lower leg, knee, upper leg, hip, pelvis, and spine regions when properly conducted thus serving as a global exercise for establishing a wood foundation for spinal function. The weighted back or front squat exercise does not incorporate spinal range of motion maneuvers due to the use of a weighted bar upon the back or front shoulders. This requires the spine to remain in an isometric neutral position throughout the exercise and imparts a compressive effect upon the spinal joints including the intervertebral discs. While having a strengthening effect upon all muscles throughout the body the weighted back or front squat will have its major effect upon the lower back, hips and thighs. During regular activities of daily living the spine functions and maneuvers in multiple motions from many positions including the squatted, seated and standing positions. There may be times when a single leg squat maneuver is required. Therefore, to remain applicable to activities of daily living, it is reasonable to establish a single and double leg squatting exercise device and program without the use of compressive loads imparted upon the spine.

Fixing the lower extremities to separate braces to assure a stable base for single or double leg squatting provides the opportunity for the individual to squat with one or both legs and exercise their spine, pelvic, hip and knee regions while freeing the spine from compressive loads and also allow for the free maneuverability of the spinal column without or with resistance. This is particularly beneficial for the elderly who have a high incidence of osteoarthrosis of the spine, hips and knees and any individual with spinal conditions such as but not limited to disc injury, osteoarthrosis and myotibrosis. These conditions preclude them from placing compressive loads on their spine, hips and knee joints. As such, there is a need to establish a lower extremity base to help assure good motor function and balance of the squat to improve efficient balance, coordination, flexibility, strength, and endurance development of the lower leg, knee, upper leg, hip, pelvis and spine regions.

Exercise devices are needed that offer the individual a stabile lower extremity base to help assure good motor function of the single or double leg squat and general balance to improve efficient flexibility, coordination, strength, and endurance development of the lower leg, knee, upper leg, hip, pelvis and spine regions with or without resistance devices attached to the device and individual.

SUMMARY OF THE ININVENTION

In one embodiment, an exercise device is disclosed. The exercise device includes: a base that includes a frame with a front side, a backside, and two lateral sides; a foot support disposed within the base for supporting the foot of a user; a vertical stabilization bar coupled to each one of the lateral sides; a horizontal lower leg stabilization bar disposed between each of the vertical stabilization bars; and a lower leg support brace mounted to the horizontal lower leg stabilization bar and configured for retaining the lower leg of the user when the foot of the user is disposed upon the foot support; wherein the exercise device is configured to provide stability to the body of the user when performing squat exercises.

The exercise device may further include a second lower leg support brace mounted to the horizontal lower leg stabilization bar. The foot support may include one of a platform and a cradle disposed therein. The foot support may include an anti-skid surface. The vertical stabilization bar may be one of mounted to the frame in a fixed geometry and adjustable in relation to the frame. The exercise device may further include a vertical stabilization bar range of motion boot configured for guiding the vertical stabilization bar. Each vertical stabilization bar may be configured to receive a vertical stabilization bar slide brace mounted thereon, each of the vertical stabilization bar slide brace configured for receiving and supporting the horizontal lower leg stabilization bar. The horizontal lower leg stabilization bar may include an integrated vertical stabilization bar slide brace at each end thereof. The horizontal lower leg stabilization bar may exhibit a cross-section that is one of substantially cylindrical and substantially planar. The exercise device may further include a foot restraint bar configured for restraining a foot of the user. The foot restraint bar may be configured to be slidably adjusted from a front of the exercise device toward a back of the exercise device. The foot restraint bar may be configured to be mounted on a pair of foot restraint rails. The exercise device may further include at least one of a set of foot restraint straps and a set of ankle restraint straps. The exercise device may further include at least one anchor disposed on the frame. At least one anchor may be configured for securing a tensioning device to provide a resistive force. At least one of the vertical stabilization bars may be configured for receiving an opposing end of the tensioning device. The tensioning device may include one of: a bungee cord, a spring, a pneumatic system or other resistance system. The base may be configured for receiving, one of a single leg of the user and both legs of the user.

In another embodiment, another exercise device is disclosed. The exercise device may include a unitary base that includes a frame with a front side, a backside, and two lateral sides; a foot support disposed within the base for supporting both the feet of a user, a vertical stabilization bar coupled to each one of the lateral sides; a horizontal lower leg stabilization bar disposed between each of the vertical stabilization bars; and a left lower leg support brace and a right lower leg support brace, each lower leg support mounted to the horizontal lower leg stabilization bar and configured for retaining the lower legs of the user when the feet of the user are disposed upon the foot support; wherein the exercise device is configured to provide stability to the body of the user when performing squat exercises.

in a further embodiment, another exercise device is disclosed. The exercise device may include two independent base sections, each base including a frame with a front side, a backside, and two lateral sides; a foot support disposed within the base for supporting the foot of a user; a vertical stabilization bar coupled to each one of the lateral sides; a horizontal lower leg stabilization bar disposed between each of the vertical stabilization bars; and a lower leg support brace mounted to the horizontal lower leg stabilization bar and configured for retaining the lower leg of the user when the foot of the user is disposed upon the foot support; wherein the exercise device is configured to provide stability to the body of the user when performing squat exercises; and, wherein each of the independent base sections is separable and movable from the other base section.

BRIEF DESCRIPTION OF THE DRAWINGS

The features and advantages of the invention are apparent from the following description taken in conjunction with the accompanying drawings in which.

DETAILED DESCRIPTION OF THE INVENTION

The present invention relates to embodiments of an exercise device to aid in performing squat exercises. The exercise device provides an aid to performing physical single or double leg squatting exercises. In one embodiment, the exercising device includes a unitary base, and may be favored for execution of a double leg squat. In another embodiment, the exercising device includes two independent bases, and may be favored for execution of a single leg squat.

In either embodiment, the exercising device is an aid to those wishing to maintain general health, occupational fitness, recreational fitness, physical fitness, athletic fitness, body building and achieve physical rehabilitation.

Generally, the exercise device provides for stabilizing one or both lower extremities in a fixed or mobile position to properly execute a single or double leg squat exercise. The stability that is achievable with the exercise device assists users with execution of related lower leg, knee, upper leg, hip, pelvic and spinal exercise maneuvers.

Figure 1A:
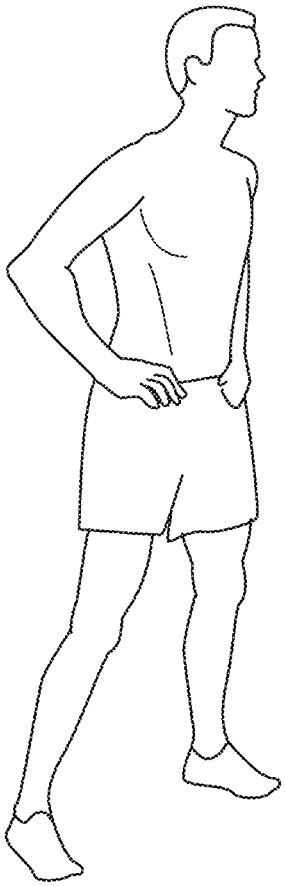
FIGS. 1A and 1B, collectively referred to herein as FIG. 1, depict an individual exercising and performing a squat exercise.
Figure 1B:
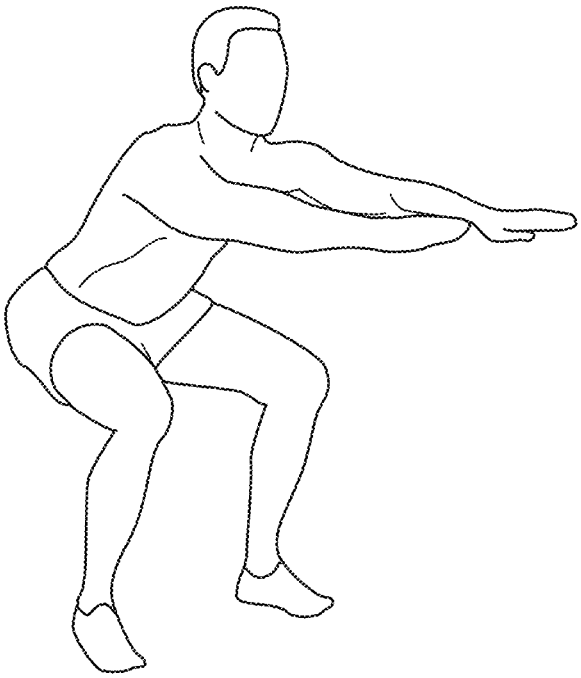

In order to provide some context, FIG. 1 depicts an individual exercising and performing a double squat exercise. In FIG. 1A, the individual is standing erect in a "neutral standing" position. In FIG. 1B, the individual is a double leg squat position. Generally, when performing the squat exercise, the individual will descend from the neutral standing position and into the squat. Typically, the individual will then ascend from the squat position and return to the neutral standing position.

As set forth herein, the term "neutral standing" generally describes a position where the feet are comfortably balanced with the pelvis and the shoulders are substantially centered over the feet. The lower legs and knees are substantially near vertical (about 85 degrees to about 90 degrees bend at the ankle) and maintained in line with the long axis of the feet and behind the toes. The spinal extensors are active under the individual's normal tone to maintain spinal curves and posture.

In descent from the neutral standing position, the buttocks are initially drawn backward. The knees are maintained over the feet with eccentric contraction stabilization of the thighs and hip musculature during descent as buttocks are drawn backward. Alternatively, the knees translate anterior to toes with eccentric contraction stabilization of the thighs and hip musculature during descent as the buttocks are drawn backward. Lumbar curve maintained during the initial half range of motion of descent with slight normal flexion occurring during the mid-range to end-range of motion in accordance with individual's mechanical physiology. The spinal extensors are activated to maintain spinal neutral stability maintaining curves and posture.

Descent depth may vary up to the individuals maximal range of knee flexion and may be ranged to ¼ (30 degrees), ½ (60 degrees), ¾ (90 degrees) or full range of motion (130 degrees) of the knees dependent on ankle, knee, hip, spinal joint mechanics, soft tissue flexibility, coordination, degrees of inflammation and individual's intent.

When an individual reaches the planned end point of descent, which may be the "neutral squat bottom (NSB)" position, the individual may immediately ascend, remain in NSB for some period before ascending or remain in the NSB position for a period adequate to conduct pelvic-spinal-torso-upper extremities re on exercises. Exercises in the neutral squat bottom (NSB) may include, for example: neutral spinal flexion with return to NSB position for repetitive exercises; neutral spinal flexion with return to normal standing position; neutral spinal flexion to the, right and/or left with return to NSB position for repetitive exercises; neutral spinal flexion to the right and/or left with return to normal standing position; neutral spinal vertical rotation right and/or left with return to NSB position for repetitive exercises; neutral spinal vertical rotation right and/or left with return to normal standing position; as well as various other exercises that challenge body regions in the full or partial squat. Additionally, the individual may evoke isometric, concentric, or eccentric contraction of thigh, hip, spinal extensor and shoulder musculature when at NSW During ascent, the quadriceps femoris and hip extensors contract with minimal to maximal recruitment of motor units for ascent with the knees remaining in alignment with the long axis of the feet; the knees over toes, mid-feet, ankles or translating from toes to mid-feet to ankle; focus on keeping knees in alignment with the long axis of the feet; focus on directing the knees to side to activate hip external rotators; and draw the buttocks forward and up. The spinal extensors are activated to maintain normal spinal curves. Alternatively, the spinal extensors are eccentrically controlled to allow for spinal flexion and subsequent extension (spinal round-up maneuver) during the ascent movement until the individual reaches the standing neutral position.

Individuals performing squat exercises may perform the cycle of descent, squatting and ascent in a variety of ways. As one example, the individual may elect to principally exercise one side of the body, or to exercise each side independently. Accordingly, embodiments of the exercising device include a unitary base, while some other embodiments include a split base, or independent bases. Thus, the description above may be applied to a bilateral or a unilateral exercise regime.

Embodiments of the exercise device disclosed herein offer individuals a stable lower extremity base to help assure good motor function of the single or double squat exercise. This permits users to improve efficient balance, coordination, flexibility, strength, and endurance development of the lower leg, knee, upper leg, hip, pelvis and spine regions. Generally, exercise devices provided in accordance with the teachings herein include a base frame, a platform, a foot anchor and at least one means for stabilizing the lower extremities. A first embodiment is provided in FIG. 1, and as an introduction.

Figure 2A:
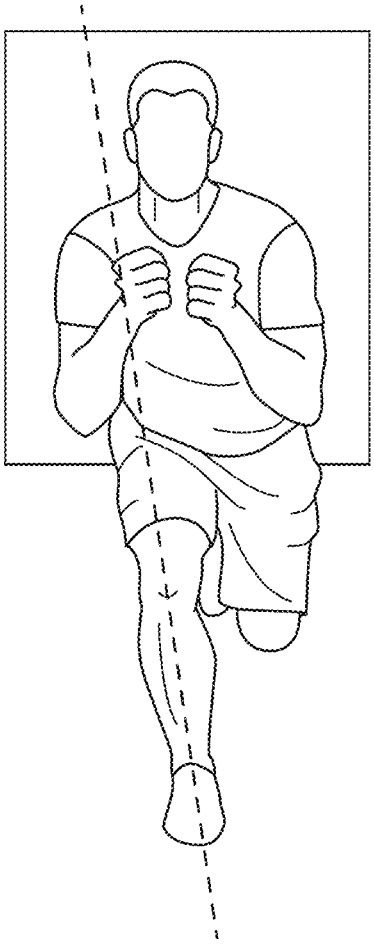
FIGS. 2A and 2B, collectively referred to herein as FIG. 2, depict an individual exercising and performing a single leg squat exercise.
Figure 2B:
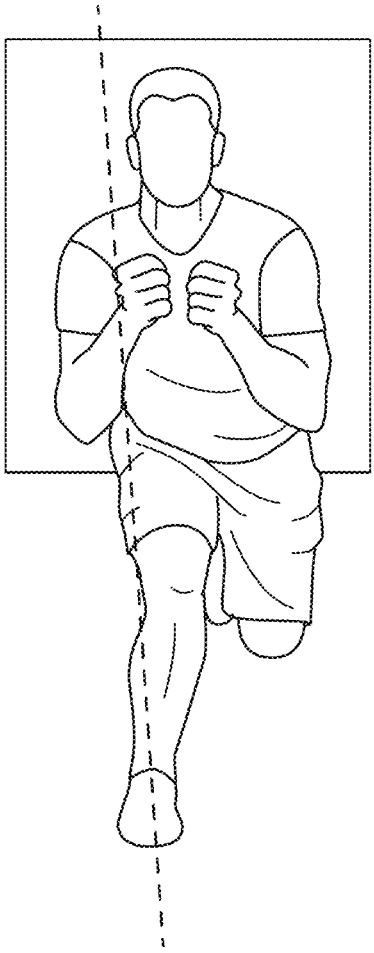

Refer now also to FIG. 2 which depicts an individual exercising and performing a single leg squat exercise. In FIG. 2A, the individual is an appropriate form, with the hip, knee and ankle generally aligned (as shown by the dashed line). In FIG. 2B, the individual is exhibiting poor form. That is, the knee is not in alignment with the hip and ankle (as shown by the dashed line). Among other things, this results in a poor distribution of stress and excessive joint wear.

Before turning to the various illustrations, it should be noted that included in the illustrations are coordinate systems (indicated with x-, y-, and z-axes) as well as terms of orientation (e.g., front, top, side). Usage of such terminology is for convenience only, and is not to be construed as limiting of the teachings herein.

Figure 3:
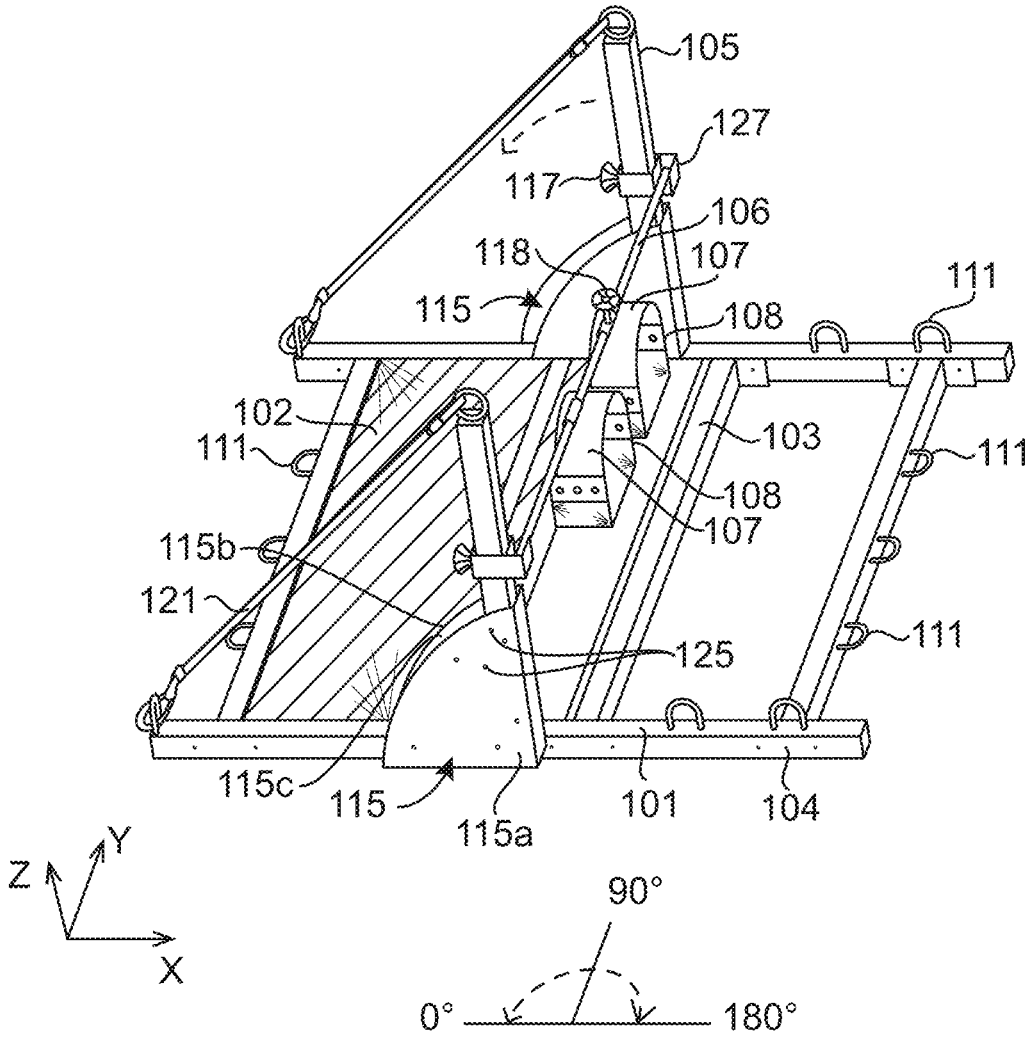
FIG. 3 is a perspective view of an embodiment of the exercise device that includes a unitary base.

Referring to FIG. 3, a first embodiment of the exercise device 100 is shown. In this example, the exercise device 100 is includes a unitary base 101. That is, as a matter of convention and for purposes of discussion, an exercise device 100 equipped with the unitary base 101 is configured for the user to simultaneously exercise each of their left side and their right side (i.e., perform a bilateral exercise regime).

As depicted in FIG. 3, the unitary base 101 includes a frame 104 with adequate room for bilateral exercise (i.e., an adequate extension in the Y-direction). Disposed within the unitary base 101 is a platform 102. Generally, the platform 102 includes a smooth and durable surface for the user to place their feet upon. In this embodiment, the platform 102 includes a non-skid surface 103 to ensure stable placement of the feet without slippage.

Disposed on each side at an approximate midpoint of the frame 104 (between the front and the back) is a vertical stabilization bar 105. Each of the vertical stabilization bars 105 may be connected to the frame 104 of the unitary base 101 by a forward opening hinge (not shown). In this example, each of the respective hinges are disposed within a respective vertical stabilization bar range of motion hoot 115. The vertical stabilization bar range of motion boot 115 may also be referred to herein simply as the "boot 115." In the example shown, the boot 115 includes a back wall that stops backward motion of the vertical stabilization bar 105 beyond that of an upright position (shown on the legend as 90 degrees). The boot 115 includes an open channel disposed between an inner wall and outer wall. The open channel provide stability for the vertical stabilization bar 105 through a range of motion from the upright position to a forward position where the vertical stabilization bar 105 lies flat and essentially parallel to the base 101 (shown on the legend as 0 degrees). Of course, when a user is using the exercising device 100, the range of motion will be substantially less. For example, the range of motion may extend between about 60 degrees forward to the upright position of 90 degrees. The boot 115 may include a number of stops 125. The stops 125 may be, for example, holes through which a pin may be inserted. Accordingly, the user may intentionally limit the range of motion of the vertical stabilization bar 105. In some additional embodiments, the boot 115 may permit a range of motion from 0 degrees to 180 degrees.

Disposed between each of the vertical stabilization bars 105 is a horizontal lower leg stabilization bar 106. In this example, the horizontal lower leg stabilization bar 106 exhibits a substantially cylindrical cross-section, At each end of the horizontal lower leg stabilization bar 106 is a respective vertical stabilization bar slide brace 127. Generally, the vertical stabilization bar slide brace 127 includes a mount that permits simple removal and maintenance or swapping of the horizontal lower leg stabilization bar 106. Each one of the vertical stabilization bar slide braces 127 includes a height adjustment feature such as height adjustment knob 117. Accordingly, a height of the horizontal lower leg stabilization bar 106 relative to the platform 102 may be easily adjusted.

Disposed on the horizontal lower leg stabilization bar 106 are two lower leg support braces 107, where one lower leg support brace 107 is for a left leg of the user, and the other lower leg support brace 107 is for the right leg of the user. Generally, the lower leg support brace 107 includes a collar that is mountable to the lower leg stabilization bar 106. The collar may be semicircular and include a strap fastener 108. When in use, the user may simply stand on the platform 102 in position their calves within each respective one of the lower leg support brace 107. Once positioned, the user simply needs to fasten the strap fastener 108 for each one of the lower leg support braces 107. The user may then begin exercising with the exercise device 100 while being firmly braced within the exercise device 100.

Generally, the mount for each of the lower leg support brace 107 is configured to rotate about the lower leg stabilization bar 106. That is, as the user enters a squat position, and when the vertical stabilization bar 105 is permitted to rotate forward, the lower leg support brace 107 will nominally rotate about the lower leg stabilization bar 106, thus remaining relatively parallel to the plane in which the platform 102 exists. Thus, each of the lower leg support braces 107 is configured to maintain a degree of comfort and flexibility for the user. Lateral movement (i.e., in the direction of the y-axis) of each of the lower leg support braces 107 along the length of the lower leg stabilization bar 106 may be restrained or permitted by adjustment of a horizontal brace adjustment, such as the horizontal brace adjustment knob 118.

Although the height adjustment and lateral movement described are shown as being controlled by adjustment knobs, other types of mechanical apparatus may be employed. For example, the adjustment may be restrained by a lever, such as a thumb latch, coupled to a cam that applies pressure to a pressure plate.

A plurality of anchors 111 may be disposed about a periphery of the frame 104 for the unitary base 101. The plurality of anchors 111 are useful for anchoring a variety of devices to the unitary base 101. For example, a tensioner 121 may be disposed on a left side and a right side of the frame 104. Generally, each tensioner 121 may function to provide resistance for exercises performed by the user. Varying levels of resistance may be employed.

Additionally, other commercially available equipment may be incorporated or used with the exercise device 100. For example, a lumbo-pelvic harness, a lumbo-pelvic resistance device, a torso harness, a torso resistance device, an adjustable seat and other such devices may be used with the exercising device, and at least some of which may be coupled to the anchors 111.

Figure 4:
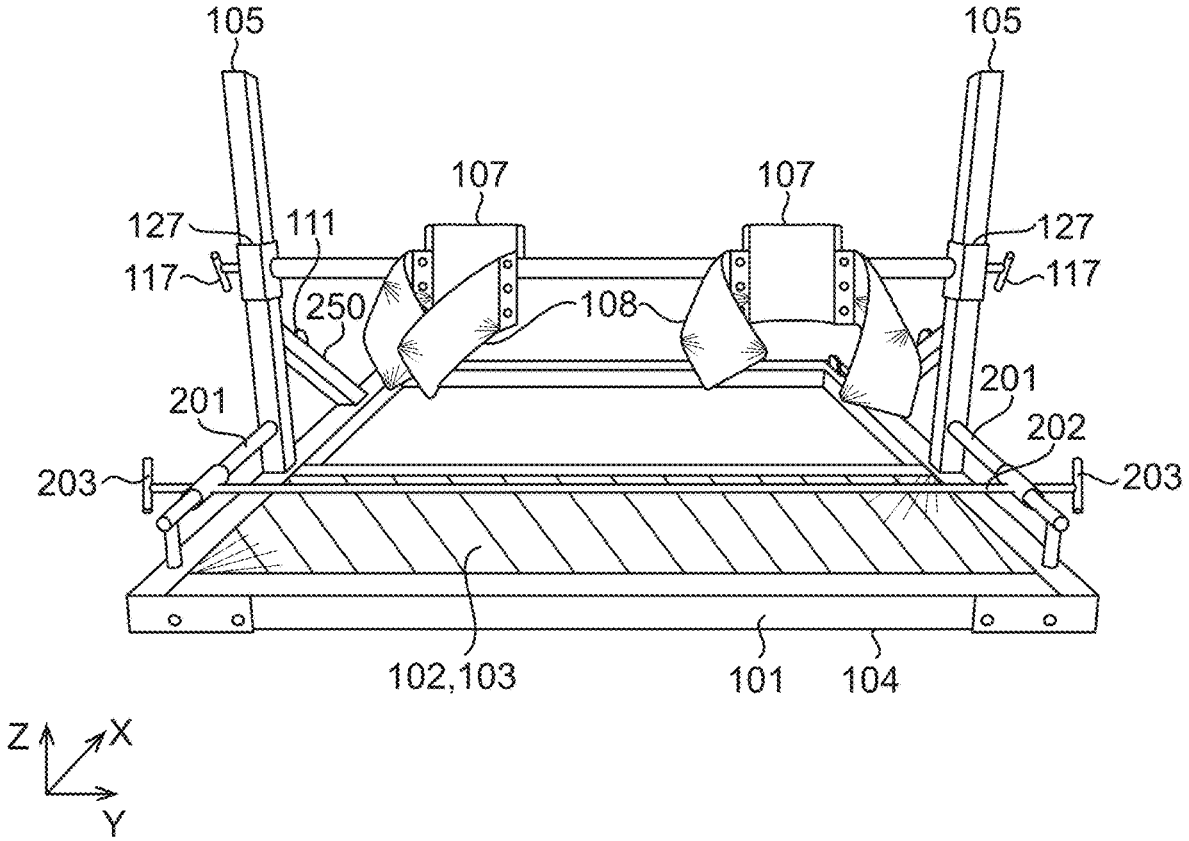
FIG. 4 is a perspective view of another embodiment the exercise device that includes a unitary base.

Referring now also to FIG. 4, an additional embodiment of the exercise device 100 is shown. In this example, the exercise device 100 is shown from the front looking toward the back of the exercise device 100. In this embodiment, the exercise device 100 includes fixed vertical stabilization bars 105. The fixed vertical stabilization bars 105 are given substantial strength by virtue of fixed brace 250. In this embodiment, the lower leg stabilization bar 106 includes integrated vertical stabilization bar slide braces 127. Generally, the lower leg stabilization bar 106 is secured at an appropriate height by a T-handled screw which is provided as the height adjustment feature 117.

Included in this embodiment is a foot restraint bar 202. The foot restraint bar 202 may be slidably adjusted from the front of the platform 102 backward towards the vertical stabilization bars 105. In this example, the foot restraint bar 202 is mounted upon a pair of foot restraint rails 201. A position of the foot restraint bar 202 may be fixed by a foot restraint adjustment 203. In this example, the foot restraint adjustment 203 includes a T-handled screw.

Figure 5:
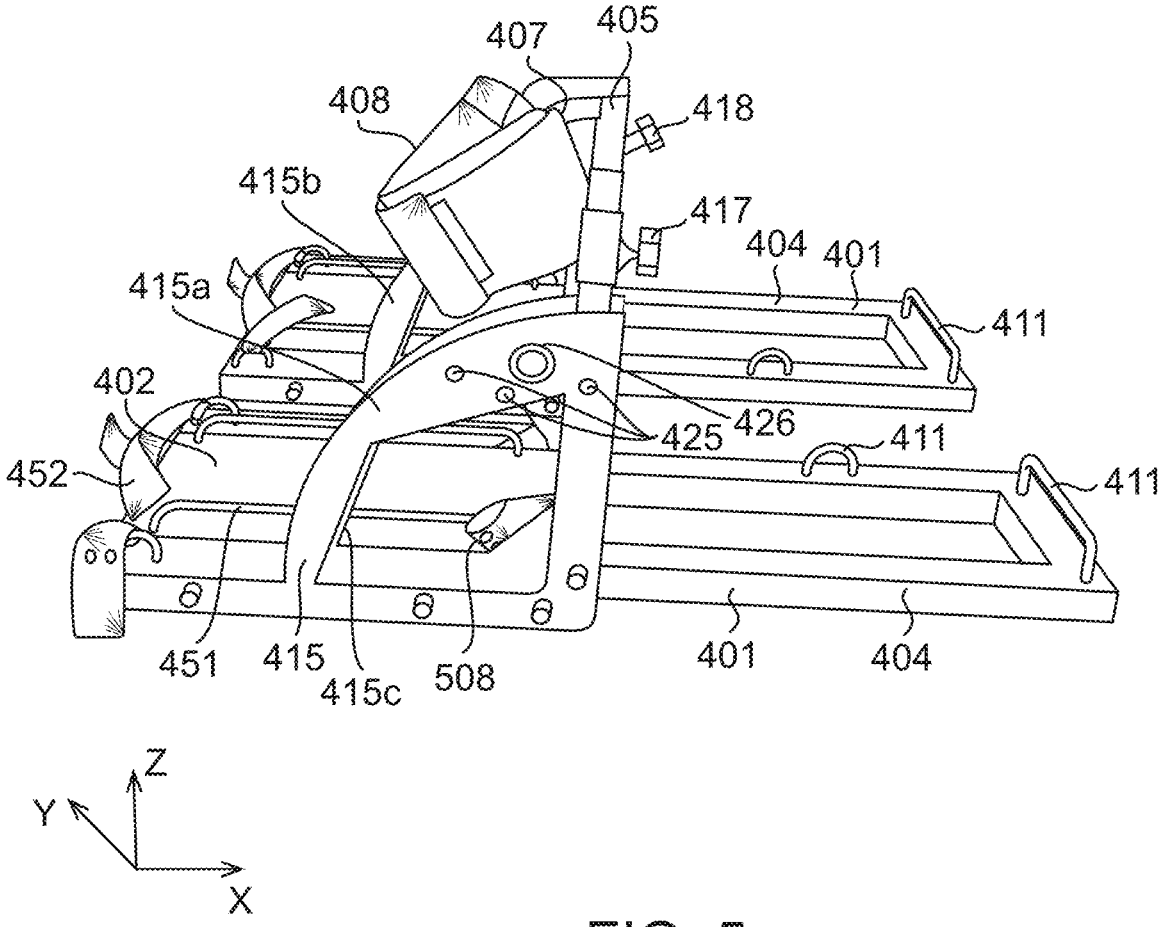
FIG. 5 is a perspective view of an embodiment of the exercise device that includes independent base components.
Figure 6:
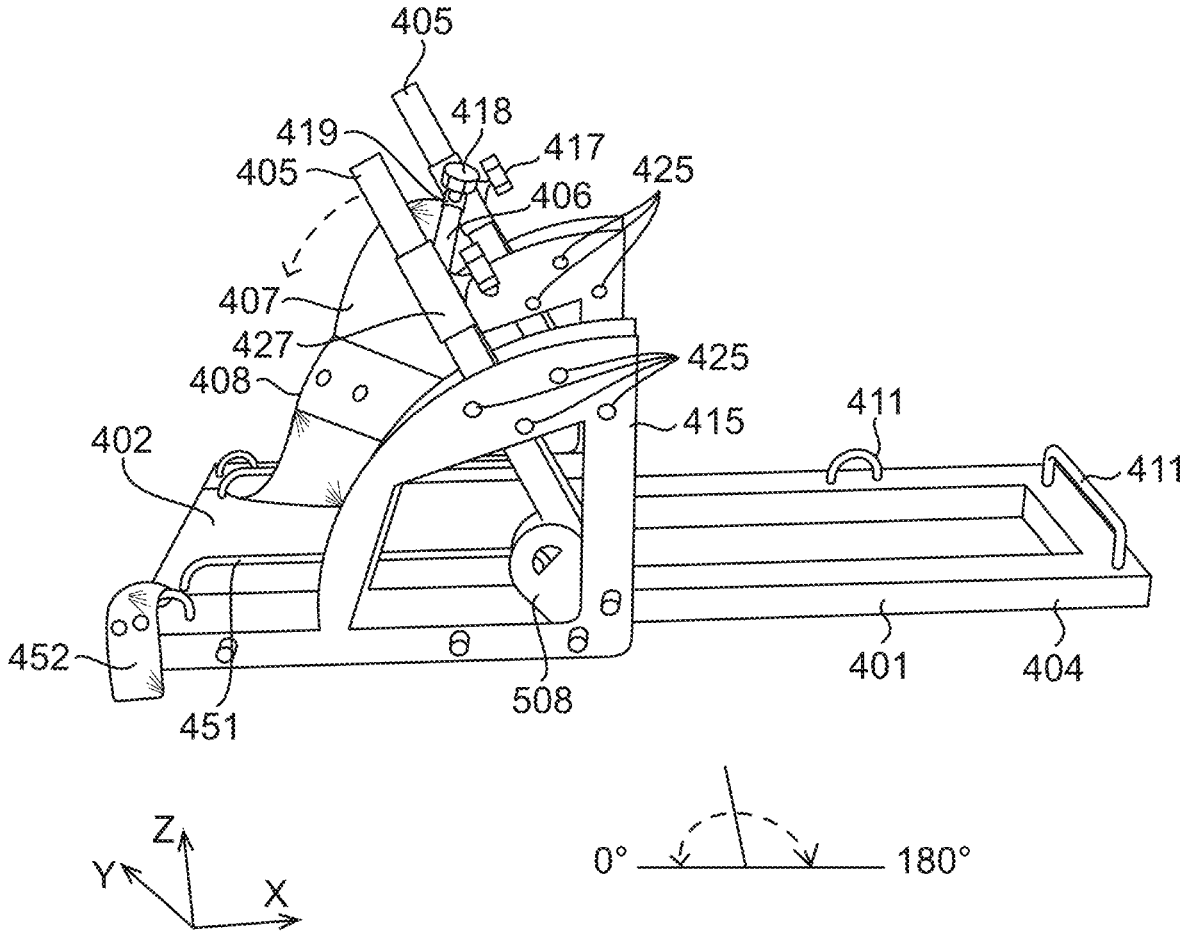
FIG. 6 is a perspective view of one of the two independent base components as shown in FIG. 4, wherein, a portion is in an unlocked position.
Figure 7:
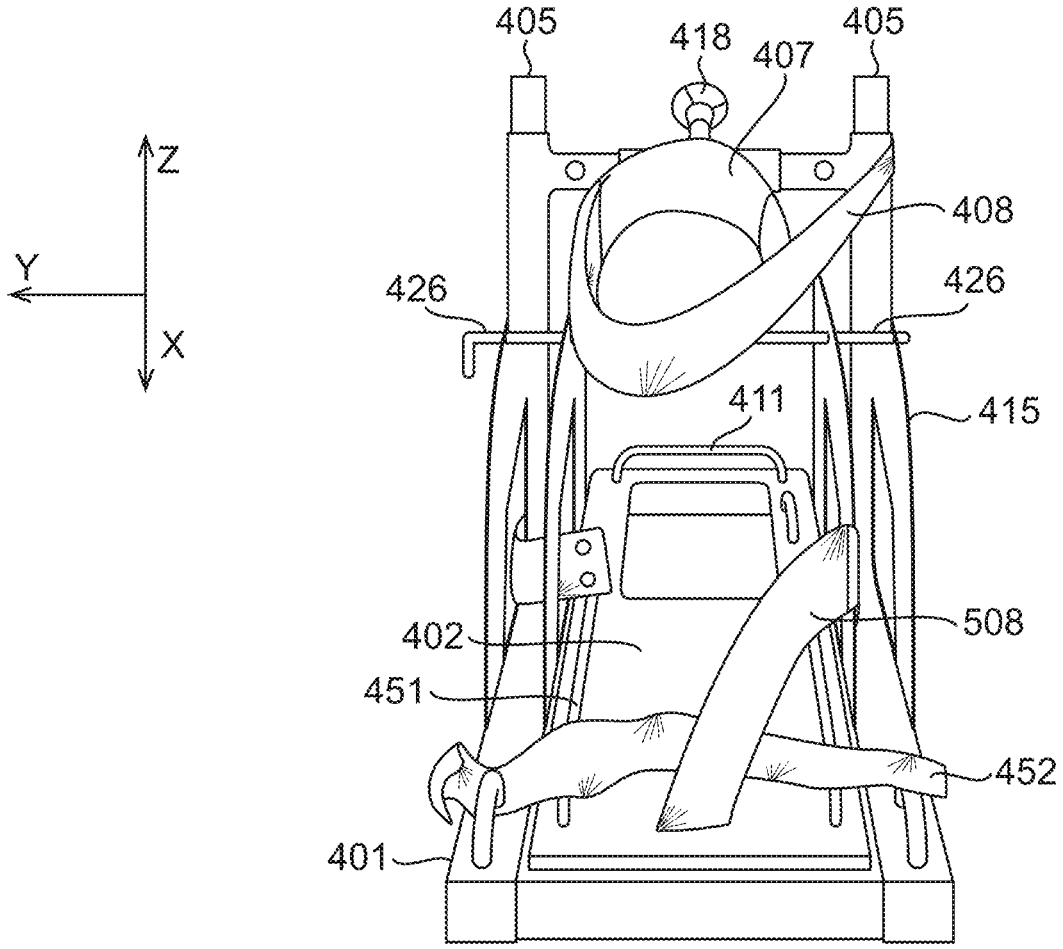
FIG. 7 is a perspective view of one of the two independent base components as shown in FIG. 4 from the front looking backward; and, FIG. 8 is a perspective view of another embodiment of the exercise device with two independent base components.

Turning now to FIGS. 5, 6 and 7, an embodiment of the exercise device 100 with independent bases is shown. For purposes of discussion, this embodiment may be referred to as an "independent exercise device 400."

Generally, embodiments of the exercise device 100 are similar to embodiments depicted in FIGS. 3 and 4. In the exercise device of FIGS. 5, 6 and 7, the exercise device 100 includes an independent base 401 for each foot. That is, each foot is provided with equipment that is independent of the other. Accordingly, a user may perform some exercises that are not achievable with the exercise device 100 that includes a unitary base 101. For example, the user may put one foot forward of the other, thus favoring exercise of one side of the body over the other.

In the exercise device 400, each independent base 401 includes an independent frame 404. Disposed within the independent base 401 is platform 402. Generally, the platform 402 includes a smooth and durable surface for the user to place their foot upon.

Disposed on each side of the independent base 401 at an approximate midpoint of the frame 404 is a vertical stabilization bar 405, Each of the vertical stabilization bars 405 may be connected to the independent frame 404 by a forward opening hinge (not shown). In this example, each of the respective hinges are disposed within a respective vertical stabilization bar range of motion boot 415, which may also be referred to herein simply as the "boot 415,"

In the example shown, the boot 415 includes a back wall that stops backward motion of the vertical stabilization bar 405 beyond out of an upright position (shown on the legend as 90 degrees). The boot 415 includes an open channel disposed between an inner wall and an outer wall. The open channel provide stability for the vertical stabilization bar 405 through a range of motion from the uptight position to a forward position. In this example, the inner wall and the outer wall of the boot 415 include a cut out region. In addition to making each of the independent base 401 lighter, this has the advantage of saving manufacturers on cost of materials.

Each of the independent base 401 includes a horizontal lower leg stabilization bar 106. The close of the lower leg stabilization bar 106 is disposed between each of the vertical stabilization bars 105. At each end of the horizontal lower leg stabilization bar 406 is a respective vertical stabilization bar slide brace 427. Generally, the vertical stabilization bar slide brace 427 includes a mount that permits simple removal and maintenance or swapping of the horizontal lower leg stabilization bar 406. Each one of the vertical stabilization bar slide braces 427 includes a height adjustment feature such as height adjustment knob 417. Accordingly, a height of the horizontal lower leg stabilization bar 406 relative to the platform 402 may be easily adjusted.

Disposed on the horizontal lower leg stabilization bar 406 is a single lower leg support brace 407 for retaining a leg of the user. Generally, the lower leg support brace 407 includes a collar that is mountable to the lower leg stabilization bar 406. The collar may be semicircular and include a strap fastener 408. When in use, the user may simply stand on the platform 402 in position their calf within the lower leg support brace 407. Once positioned, the user simply needs to fasten the strap fastener 408 for the lower leg support braces 407. The user may then begin exercising with the exercise device 100 while being firmly braced within the exercise device 100.

Generally, the mount for the lower leg support brace 407 is configured to rotate about the lower leg stabilization bar 406. That is, as the user enters a squat position, and when the vertical stabilization bar 405 is permitted to rotate forward, the lower leg support brace 407 will nominally rotate about the lower leg stabilization bar 406, thus remaining relatively parallel to the plane in which the platform 402 exists. Thus, the lower leg support brace 407 is configured to maintain a degree of comfort and flexibility for the user. Lateral movement (i.e., in the direction of the y-axis) of the lower leg support brace 407 along the length of the lower leg stabilization bar 406 may be restrained or permitted by adjustment of a horizontal brace adjustment, such as the horizontal brace adjustment knob 418.

Although the height adjustment and lateral movers described are shown as being controlled by adjustment knobs, other types of mechanical apparatus may be employed. For example, the adjustment may be restrained by a lever, such as a thumb latch, coupled to a cam that applies pressure to a pressure plate.

A plurality of anchors 411 may be disposed about a periphery of the frame 404 for the independent base 401. The plurality of anchors 411 are useful for anchoring a variety of devices to the independent base 401. For example, a tensioner (see FIG. 3) may be disposed on a left side and a right side of the frame 404. Generally, each tensioner may function to provide resistance for exercises performed by the user. Varying levels of resistance may be employed.

Additionally, other commercially available equipment may incorporated or used with the exercise device 100. For example, a lumbo-pelvic harness, a turbo-pelvic resistance device, a torso harness, a torso resistance device, an adjustable seat and other such devices may be used with the exercising device, and at least some of which may be coupled to the anchors 411.

In this example, each independent base 401 also includes a set of foot restraint rails 451, Mounted to the set of foot restraint rails 451 are foot restraint straps 452. A pair of ankle restraint straps 508 are mounted to a vertex of the boot 415, or substantially in the vicinity of the coupling of the vertical stabilization bar 405 and the frame 401. Collectively, the foot restraint strap 452 and the ankle restraint strap 508 cooperate to secure the foot of the user securely in place upon the platform 402.

Also shown in this example, is a plurality of stops 425. In this example, the stops 425 include a series of through holes that pass through the walls of the boot 415. At least one pin 426 may be passed through a respective set of the holes to provide the stopping function for limiting the forward motion of the vertical stabilization bars 405.

Figure 8:
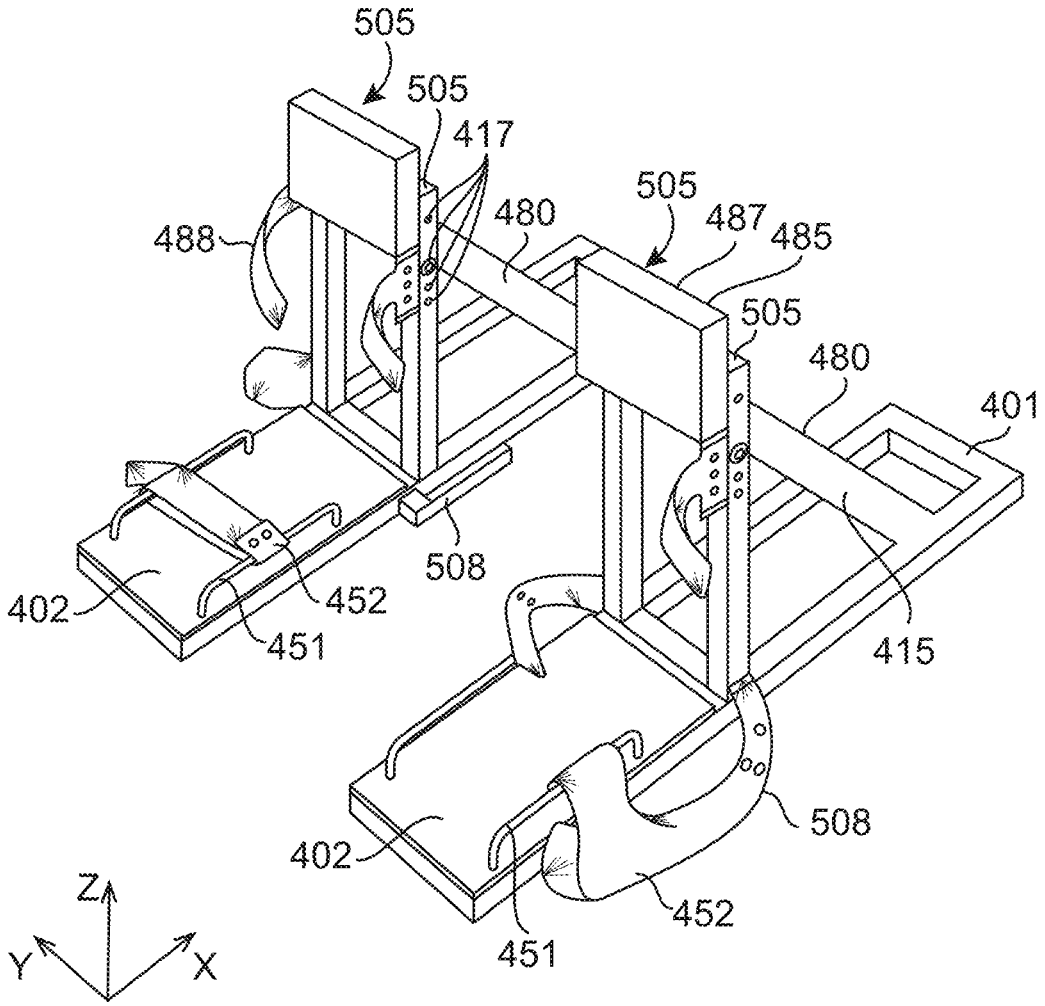

Referring now also to FIG. 8, an additional embodiment of the exercise device 100 is shown. In this example, the exercise device 100 includes the independent base 401 for the left side of the user, and another independent base 401 for the right side of the user.

In this embodiment, the exercise device 100 includes a fixed lower leg support brace 487. The fixed lower leg support brace 487 includes padding 485 against which the calf of the user is placed. The calf of the user is secured against the padding 485 by securing strap fastener 488. The fixed lower leg support brace 487 is not entirely fixed. That is, in this embodiment, the height of the fixed lower leg support brace 487 may be adjusted by taking advantage of the height, adjustment feature 417. In this example, the height adjustment feature 417 includes a plurality of holes distributed alongside a height of a fixed vertical stabilization bar 505. The fixed vertical stabilization bar 505 may be braced against the frame by vertical stabilization bar fixed brace 480. At least one pin may be inserted through an embodiment of a horizontal lower leg stabilization bar 487 that exhibits a substantially planar cross-section and through a selected hole of the height adjustment feature 417.

In this example, each independent base 401 also includes a set of foot restraint rails 451. Mounted to the set of foot restraint rails 451 are foot restraint straps 452. A pair of ankle restraint straps 508 are mounted to a vertex of the boot 415. Collectively, the foot restraint strap 452 and the ankle restraint strap 508 cooperate to secure the foot of the user securely in place upon the platform 402.

Having introduced various embodiments of the exercising device, some additional aspects and features are now set forth.

Generally, the exercise device may be fabricated from any devices, materials, components and by application of any techniques as deemed appropriate. Generally, selected materials and methods are within the discretion of a user, designer, manufacturer or other similarly interested party.

By way of non-limiting example, components of the exercise device 100 may be fabricated from heavyweight steel, Use of heavy steel may be appropriate in order to provide sufficient weight as may be needed to counteract forces applied by an exercising user, as well as to provide a suitable degree of strength for heavy usage as might occur in a doctor's office, a rehabilitation facility, at a gym, or other suitable facility. In some embodiments, the platform may be fabricated from wood, such as a finished grade quality plywood. In some embodiments, the anti-skid surface includes a tape, such as the SAFETY WALK™ Products available from 3M Corporation of St. Paul, Minn. Tensioning devices (also referred to as a "resistance device") for use as the tensioner may include a rubber bungee cord, a spring (e.g., a plastic spring or a metallic spring) a pneumatic system (such as a shock absorber) or other similar device.

Although positional adjustment devices have been shown generally as including a threaded screw type of device or a pin and thruway type of device, other systems may be used. For example, a rack and pinion gear assembly may be used and may include a locking mechanism.

The various forms of strapping disclosed herein may be provided with any type of material deemed appropriate. As one example, the various forms of strapping includes nylon strapping. The strapping may be fastened as deemed appropriate. For example, the strapping may be fastened with hook and loop type of fasteners (such as available from the Velcro Corporation of Manchester. N.H.), snaps, a conventional belt with a buckle, with laces, or other similar devices.

Other embodiments of the exercise device may be realized. In some embodiments, the exercise device is configured so as to be collapsible and/or mobile. In some embodiments, the exercise device is configured with cost in mind, such as for a home user. For example, high density/high-strength plastic may be used in place of at least some of the steel components.

As mentioned above, other devices may be used in conjunction with the exercise device. For example, in addition to the tensioner device shown in FIG. 3, another set of tensioner devices may be deployed along a backside of the frame, thus imparting resistance in the forward or backward direction (i.e., where the boots permit 180 degrees of travel).

In general, the exercise device includes a base frame or platform, foot anchor, a foot platform, and at least one means for stabilizing the lower extremities.

In some embodiments, the platform may be displaced by a cradle (not shown) for each foot. Further, the cradle may rotate about a bar (not shown). Thus, the user may be able to extend the foot such that toes are depressed below (or above) a height of the heel. In unitary embodiments, the cradle may be permitted to slide laterally (i.e., along the Y-axis direction). In some embodiments, the platform is at least partially rotatable.

Commercially available equipment which may be incorporated into the device may include but are not limited to: a lower leg resistance device, a lumbo-pelvic harness, a lumbo-pelvic resistance device, a torso harness, a torso resistance device, an adjustable seat.

Devices in accordance with the present invention may assist in improving the flexibility balance, coordination, flexibility, strength and endurance of the lower leg, knee, upper leg, hip, pelvic and spinal neuromusculoskeletal connective tissue regions and kinetic systems.

Devices in accordance with the present invention may also be useful in improving cardiovascular and respiratory fitness of an individual, as the individual continuously exercises their lower leg, knee, upper leg, hip, pelvic and spinal regions over extended periods of time.

The present invention may also help provide the benefits of a. single or double leg squat and spinal exercise without exerting substantial compression forces upon the spine.

The present invention also provides a method to do single or double leg squats and simultaneously exercise and train the spinal-pelvic neuromusculoskeletal system in flexion, extension, and rotation maneuvers with or without resistance and with or without direct compressive imposed upon the spinal column.

It is contemplated that the present invention will serve to improve joint flexibility and coordination of ankles, knees, hips, lumbo-pelvic, spine regions with or out variable resistance, It is further contemplated that devices and methods in accordance with the present invention will improve muscular strength, endurance and coordination of thighs, hip extensors, and pelvic-spinal extensor musculature with or without variable resistance.

Devices and methods in accordance with the present invention may provide for the ability of the individual to conduct a single or double leg squat maneuver with the lower extremity fixed at a particular ankle angle.

Devices and methods in accordance with the present invention may provide for the ability of the individual to conduct a single or double leg squat maneuver with the lower extremity mobile through a particular range of the ankles.

Devices and methods in accordance with the present invention may provide for the ability of the individual to conduct a single or double leg squat maneuver with the lower extremity fixed at a particular ankle angle and simultaneously conduct exercises of the spinal/torso/upper extremities region without compressive force upon the spine.

Devices and methods in accordance with the present invention may provide for the ability of the individual to conduct a single or double leg squat maneuver with the lower extremity mobile through a particular range of the ankles and simultaneously conduct exercises of the spinal/torso/upper extremities region with compressive force upon the spine.

The present invention offers the individual a stable lower extremity base to help assure good motor function of the single or double leg squat to improve balance, coordination, flexibility, strength, and endurance development of the lower leg, knee, upper leg, hip, pelvis and spine regions.

Single or double leg squat mechanics of the lower leg, knee, upper leg, hip, pelvis and spine regions varies in relation to the individual's biomechanical and physiologic function. This following description of the squat is to establish a basic foundation for all individuals to establish and modify according to individual needs and is not an absolute requirement of proper squat execution. The device may be rubber tubing, spring, resistance cable, pneumatic, electromagnet, or other type of resistance capacity.

Lumbo-Pelvic Harness: Harness wraps around the lumbo-pelvic region to provide resistance attachments for the Lumbo-Pelvic Resistance Device. Lumbo-Pelvic Resistance Device: A device providing variable resistance to the vertical movement of the lumbo-pelvic region during the ascent of the squat exercise. The device is attached to the Base Frame or Platform along the portion and the Lumbo-pelvic Harness. The device may be rubber tubing, spring, resistance cable, pneumatic, electromagnet, or other type of resistance capacity. Torso Harness: Harness wraps around the torso region to provide resistance attachments for the Torso Resistance Device. Torso Resistance Device: A device providing variable resistance to the vertical and angular movements of the torso region during the squat exercise. The device is attached to the front of the Base Frame or Platform and the Torso Harness. The device may be rubber tubing, spring, resistance cable, pneumatic, electromagnet, or other type of resistance capacity.

It should be noted that some of the terminology set forth herein may be in agreement, or only partially in agreement with terminology set forth in prior related provisional patent applications. One skilled in the art will recognize the various uses of terms and be able to make the distinctions. However, if a conflict should exist, terminology is set forth in this disclosure shall prevail. It should be recognized that some adjustment and terminology has been provided to simplify explanation. No conflicts in terminology should be construed or inferred.

All statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function regardless of structure, In the disclosure hereof any element expressed as a means for performing a specified function is intended to encompass any way of performing that function. Applicants thus regard any means which can provide those functionalities as equivalent to those shown herein.

Various other components may be included and called upon for providing for aspects of the teachings herein. For example, additional materials, combinations of materials and/or omission of materials may be used to provide for added embodiments that are within the scope of the teachings herein.

When introducing elements of the present invention or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements. The usage of the term "exemplary" is to be construed as meaning one of many possible embodiments. The term "exemplary" is not to be construed as being necessarily indicative of a superior or superlative embodiment, although, in some instances this may be the case.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation, or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An exercise device that includes:

one or more base sections, each base section including a frame with a front side, a backside, and two lateral sides, wherein each of the one or more base sections comprises:

a platform for supporting a foot of a user;

at least one vertical stabilization bar coupled to each one of the lateral sides;

a horizontal lower leg stabilization bar disposed between each of the at least one vertical stabilization bars;

at least one lower leg support brace mounted to the horizontal lower leg stabilization bar, the lower leg support brace comprising a platform and a cradle therein; and a vertical stabilization bar range of motion boot configured for guiding the at least one vertical stabilization bar;

wherein each of the one or more base sections is separable and movable from the other base section; and wherein each of the one or more base sections further includes a set of foot restraint devices configured for restraining a foot a of the user, and wherein a slidably adjustable foot restraint device is mounted to the set of foot restraint devices.

2. The exercise device as in claim 1, wherein the platform is at least partially rotatable about an axis extending from one of the lateral sides to the opposite lateral side.

3. The exercise device as in claim 1, wherein the platform of the exercise device includes an anti-skid surface.

4. The exercise device as in claim 1, wherein the at least one vertical stabilization bar is either mounted to the frame in a fixed geometry or adjustable in relation to the frame.

5. The exercise device as in claim 1, wherein the vertical stabilization bar range of motion boot comprises a plurality of stops limiting the range of motion of the at least one vertical stabilization bar.

6. The exercise device as in claim 1, wherein each of the at least one vertical stabilization bars is configured to receive a vertical stabilization bar slide brace mounted thereon, and the vertical stabilization bar slide brace is configured to receive and support the horizontal lower leg stabilization bar.

7. The exercise device as in claim 1, wherein each lower leg support brace is configured to adjust a height of the horizontal lower leg stabilization bar.

8. The exercise device as in claim 1, wherein the horizontal lower leg stabilization bar includes an integrated vertical stabilization bar slide brace at each end thereof.

9. The exercise device as in claim 1, wherein the horizontal lower leg stabilization bar exhibits a cross-section that is either substantially cylindrical or substantially planar.

10. The exercise device as in claim 1, wherein each of the one or more base sections further includes an ankle restraint device configured to restrain an ankle of the user, and wherein the ankle restraint device is one of a bar and strap.

11. The exercise device as in claim 1, further including at least one anchor disposed on the frame of each the one or more base sections.

12. The exercise device as in claim 11, wherein the at least one anchor secures a tensioning device to provide a resistive force.

13. The exercise device as in claim 12, wherein one of the at least one vertical stabilization bars receives an opposing end of the tensioning device.

14. The exercise device as in claim 13, wherein the tensioning device includes one of a bungee cord, a spring, and a pneumatic system.

15. The exercise device as in claim 1, wherein the vertical stabilization bar range of motion boot comprises an inner wall, outer wall, a back wall, and a cut-out region.

16. The exercise device as in claim 1, wherein the lower leg support brace comprises a collar configured to be mounted to the horizontal lower leg stabilization bar of the one or more base sections.

17. The exercise device as in claim 16, wherein a mount for each lower leg support brace is configured to rotate about the horizontal lower leg stabilization bar.

18. The exercise device as in claim 6, wherein the vertical stabilization bar slide brace includes a height adjustment mechanism for adjusting the height of the horizontal lower leg stabilization bar relative to the platform of the exercise device.

19. The exercise device as in claim 18, wherein the height adjustment mechanism is one of a knob, lever, and thumb latch.

20. The exercise device as in claim 1, wherein the slidably adjustable foot restraint device is one of a bar and strap.

21. The exercise device as in claim 1, wherein the set of foot restraint devices is a pair of opposing bars.

* * * * *